US012435403B2

(12) United States Patent
Nasserrafi et al.

(10) Patent No.: US 12,435,403 B2
(45) Date of Patent: Oct. 7, 2025

(54) METHOD TO PRODUCE LOW-COST METAL MATRIX COMPOSITES FOR INDUSTRIAL, SPORTS, AND COMMERCIAL APPLICATIONS

(71) Applicant: Spirit AeroSystems, Inc., Wichita, KS (US)

(72) Inventors: Rahbar Nasserrafi, Wichita, KS (US); Kerrick Dando, Wichita, KS (US); Gerald Hicks, Wichita, KS (US)

(73) Assignee: Spirit AeroSystems, Inc., Wichita, KS (US)

( * ) Notice: Subject to any disclaimer, the term of this patent is extended or adjusted under 35 U.S.C. 154(b) by 0 days.

(21) Appl. No.: 18/131,549

(22) Filed: Apr. 6, 2023

(65) Prior Publication Data

US 2024/0337005 A1 Oct. 10, 2024

(51) Int. Cl.

| | |
|---|---|
| ***B22D 18/06*** | (2006.01) |
| ***B22D 17/00*** | (2006.01) |
| ***B22D 19/14*** | (2006.01) |
| ***B22D 30/00*** | (2006.01) |
| ***C22C 47/04*** | (2006.01) |
| ***C22C 47/08*** | (2006.01) |

(52) U.S. Cl.

CPC ..... *C22C 47/08* (2013.01); *B22D 17/00* (2013.01); *B22D 18/06* (2013.01); *B22D 19/14* (2013.01); *B22D 30/00* (2013.01); *C22C 47/04* (2013.01)

(58) Field of Classification Search

CPC ..... B22D 17/00; B22D 18/06; B22D 19/14; B22D 30/00

See application file for complete search history.

(56) References Cited

U.S. PATENT DOCUMENTS

| | | | | |
|---|---|---|---|---|
| 3,860,443 | A | 1/1975 | Lachman et al. | |
| 3,940,262 | A * | 2/1976 | Niebylski | C22C 47/08 428/614 |
| 4,341,823 | A * | 7/1982 | Sexton | D01F 11/127 428/614 |
| 4,409,298 | A | 10/1983 | Albertson et al. | |
| 4,450,207 | A | 5/1984 | Donomoto et al. | |
| 4,515,866 | A | 5/1985 | Okamoto et al. | |
| 4,995,444 | A * | 2/1991 | Jolly | C04B 41/009 164/100 |

(Continued)

FOREIGN PATENT DOCUMENTS

| | | | |
|---|---|---|---|
| CN | 113930645 | A * | 1/2022 |
| WO | 2014136219 | | 9/2014 |

OTHER PUBLICATIONS

European Search Report, Europe Patent Application No. 24168716.9, dated Sep. 3, 2024, 10 pages, European Patent Office, Munich, Germany.

*Primary Examiner* — Keith Walker
*Assistant Examiner* — Steven S Ha
(74) *Attorney, Agent, or Firm* — Stinson LLP

(57) ABSTRACT

A method of forming a metal matrix composite component includes positioning a preform including an electrically non-conductive fibrous material in a shaping tool. The fibrous material is pre-coated. The method includes flowing a molten metal comprising zinc into the shaping tool so that at least a portion of the preform is enveloped by the molten metal to form the metal matrix composite component; and cooling the metal matrix composite component.

10 Claims, 8 Drawing Sheets

(56) References Cited

U.S. PATENT DOCUMENTS

| | | | | |
|---|---|---|---|---|
| 5,385,195 | A | 1/1995 | Bell et al. | |
| 5,454,403 | A * | 10/1995 | Kerr | C22C 47/20 139/420 R |
| 5,669,059 | A * | 9/1997 | Carden | C22C 1/05 419/23 |
| 2002/0020510 | A1 * | 2/2002 | Nakao | B22D 17/203 164/113 |
| 2003/0180172 | A1 * | 9/2003 | Oda | B22F 7/08 419/5 |
| 2012/0164429 | A1 * | 6/2012 | Shah | B82Y 30/00 428/293.1 |
| 2017/0216911 | A1 * | 8/2017 | Sabah | C22C 47/12 |
| 2019/0169725 | A1 | 6/2019 | Rios et al. | |

* cited by examiner

METHOD TO PRODUCE LOW-COST METAL MATRIX COMPOSITES FOR INDUSTRIAL, SPORTS, AND COMMERCIAL APPLICATIONS

BACKGROUND

Due to its weight and strength ratio, aluminum is used in die casting processes to form structural components, such as vehicle chassis. However, aluminum has a relatively high melting temperature. Due to the high melting temperature, a relatively significant amount of pressure is required to press molten aluminum to properly cast the aluminum. In addition, the rather high melting temperature requires utilization of specialized and expensive tooling material. Thus, aluminum die casting and recycling requires a relatively large amount of energy, which reduces sustainability metrics of aluminum.

The background discussion is intended to provide information related to the present invention which is not necessarily prior art.

SUMMARY

In some embodiments, a method of forming a metal matrix composite component includes positioning a preform including an electrically non-conductive fibrous material in a shaping tool. The fibrous material is pre-coated. The method further includes flowing a molten metal having zinc into the shaping tool so that at least a portion of the preform is enveloped by the molten metal to form the metal matrix composite component; and cooling the metal matrix composite component.

In another embodiment, a method of forming a metal matrix composite includes infusing a molten metal having zinc with an additive to form an infused molten metal. The additive includes at least one of boron, titanium, zirconium, hafnium, silicon, manganese, or a rare earth element. The method further includes enveloping at least a portion of a reinforcement material with the infused molten metal to form the metal matrix composite. The reinforcement material includes an electrically nonconductive fiber coated with nickel.

In yet another embodiment, a material composition for a metal matrix composite includes 3% to 15% by weight of aluminum; 0.05% to 4% by weight of copper; 0.05% to 2% by weight of at least one of boron or titanium; 0.01% to 0.1% by weight of at least one of silicon or manganese; 0.005% to 0.3% by weight of a rare earth element; 0.005% to 0.03% by weight of nickel; and 78.57% to 96.88% by weight of zinc.

In yet another embodiment, a method of metal injection composite casting includes melting a mixture of metal and a reinforcement material to form a molten mixture. The metal includes zinc, and the reinforcement material includes an electrically nonconductive fiber that is at least partially coated in nickel. The method further includes injecting the molten mixture into a cavity of a die set.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
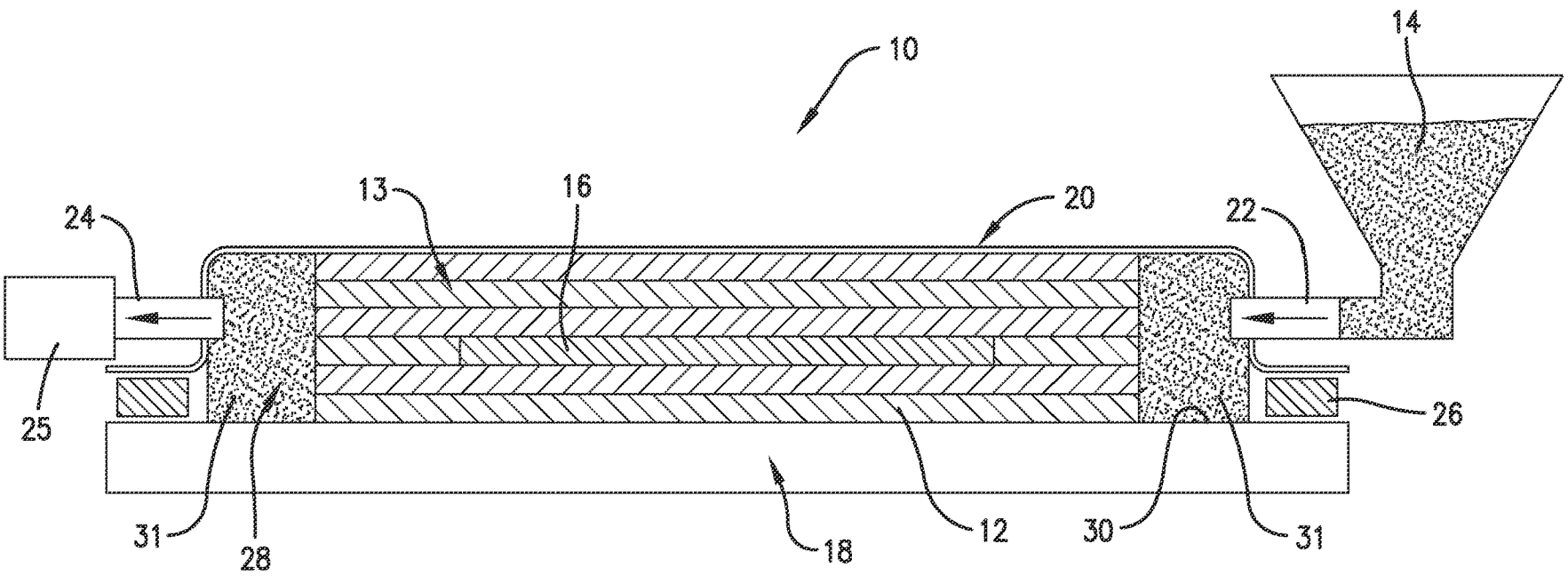
FIG. 1 is a schematic cross-sectional side view of a vacuum bag and mold system for forming a metal matrix composite component according to an embodiment of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Embodiments of the invention include systems and methods of forming a metal matrix composite, systems and methods of forming a metal matrix composite component, and a material composition. The systems and methods involve wetting nickel-coated fibers with molten zinc-based metals. The preform or fibers comprise fibrous material that is electrically nonconductive. The term "electrically nonconductive" means a material within which electric current does not freely flow, i.e., a material with a resistivity greater than about one thousand (1,000) ohm-meter or at least ten thousand (10,000) ohm-meter. Examples of electrically nonconductive fibers include, but are not limited to, glass fiber, carbon fiber, silica fiber, silicon carbide fiber, aluminum oxide fiber, magnesium oxide fiber, and/or basalt fiber. In embodiments, the fibrous material comprises different types of such fibers that are commingled.

In embodiments, one or more wires are secured to and/or commingled with the fibers, such as by weaving or braiding the wires into fabrics. In embodiments, the wire comprises at least one of zinc, titanium, aluminum, steel, copper, or the like. In some embodiments, the wire has a metal coating as well, such as a nickel coating, for example. Metallic reinforcement of wire strengthens the composite, toughens the composite, and acts as a crack growth inhibitor.

Methods of coating portions of the preform include electroless nickel plating processes (such as for electrically nonconductive fibrous material), electrodeposited nickel-plating processes, and chemical vapor deposition. Embodiments of the invention enable the use of recycled fiber, which significantly reduces fiber costs for manufacturing a metal matrix composite or metal matrix composite component. For purposes of the description below, the coated preform and/or fibers will be described as nickel-coated, but it should be understood by one having ordinary skill in the art that the preform can be coated with any conductive metal having metallurgical compatibility using any known coating technique.

The nickel-coated fibers are cast in the zinc-based molten metal. Embodiments of the invention include gravity casting, die casting, vacuum assisted die casting, vacuum bag casting, and the like using one or more shaping tools. As used herein, "shaping tools" include any type of manufacturing equipment used to perform manufacturing processes to shape and form materials into specific shapes and sizes, and can include molds, dies, membranes, jigs, fixtures, and other specialized equipment.

In embodiments, the zinc-based molten metal is a zinc alloy. The zinc alloy is similar to ZAMAK alloys; however, the molten metal does not include magnesium, or only includes a relatively small amount of magnesium. The magnesium is replaced by micro-additions of (i) nickel to enhance intergranular corrosion resistance of the zinc metal matrix composite and (ii) elements known for a capacity to deoxidize molten metal to ensure removal of oxide film and full wetting/mixing of coated fiber into metal matrix. The elements known for a capacity to deoxidize have higher affinity for oxygen (lower free energy) than nickel and are in the range of 0.05% to 1.5% within the zinc base alloy. In embodiments, the added elements include boron, titanium, silicon, or the like. In embodiments, the molten metal is infused with at least one of zirconium, hafnium, manganese, phosphorous, or a rare earth element. The addition of boron in excess of 0.1%, for example, in the molten metal results in aluminum diboride forming in the molten metal, which then reacts with the aluminum in the molten metal to form an in-situ zinc-aluminum-aluminum diboride. When such a molten metal is used with the nickel-coated preform described above to form a composite via methods and systems according to embodiments of the present invention, the resulting composite demonstrates significant reduction in grain size and enhanced castability and mechanical properties.

In some embodiments, the zinc-based alloy comprises: 3% to 15% by weight of aluminum; 0.05% to 4% by weight of copper; 0.05% to 2% by weight of at least one of boron or titanium; 0.01% to 0.1% by weight of at least one of silicon or manganese; 0.005% to 0.3% by weight of a rare earth element; 0.005% to 0.03% by weight of nickel; and 78.57% to 96.88% by weight of zinc.

In other embodiments, the zinc-based alloy comprises: 0.1% to 1.5% by weight of boron or 0.05% to 0.3% by weight of titanium; 0.01% to 0.02% by weight of nickel; and the rest being Zn-4Al.

In other embodiments, the zinc-based alloy comprises: 0.1% to 1.5% by weight of boron or 0.05% to 0.3% by weight of titanium; 0.01% to 0.02% by weight of nickel; and the rest being Zn-4Al-5Cu.

In other embodiments, the zinc-based alloy comprises: –0.1% to 1.5% by weight of boron or 0.05% to 0.3% by weight of titanium; 0.01% to 0.02% by weight of nickel; and the rest being Zn-12Al-1Cu.

In other embodiments, the zinc-based alloy comprises: 0.1% to 1.5% by weight of boron or 0.05% to 0.3% by weight of titanium; 0.01% to 0.02% by weight of nickel; and the rest being Zn-10Al-5Cu.

In some embodiments, silicon or manganese replace all or part of the boron or titanium additions. Some embodiments of the invention include modifying the microstructure of the metal matrix composite by adding trace amounts of sodium, calcium, or strontium.

Once the nickel coated fibers or preform are wetted and encapsulated by the zinc-based molten metal, the composite or component is cooled and allowed to solidify at room temperature. The composite or component is then removed, heat treated (if required), and finished. In embodiments, the fiber content of the composite or component is 10% to 30% of the weight thereof.

Because the zinc-based alloys of the present invention are melted at 800-900° F., cheaper dies and lower pressure die casting machines than those used for aluminum-based alloys can be used. The zinc-based alloys of the present invention also require lower injection pressures and temperatures. Further, zinc is fully recyclable and is cheaper than aluminum. This results in zinc-based alloys having a lower carbon footprint compared to aluminum-based alloys. Further, as compared to aluminum-based alloys, zinc-based alloys with fiber reinforcement have superior performance metrics. Zinc-based die casting alloys also demonstrate a better strength-to-weight ratio, enable a lower total weight of a composite or component, have better fatigue performance, demonstrate higher strength, demonstrate higher ductility (depending on the specific formulation), and have better castability than aluminum-based alloys. Zinc-based alloys also have good corrosion resistance and excellent dimensional stability and machinability.

Embodiments of the invention enable the rapid manufacturing of a wide range of components, from car parts and electronic devices to medical implants and consumer goods. The components include small, high-strength, and low cost components as well as large, high-grade structures such as aircraft components, vehicle chassis, and the like.

Figure 2:
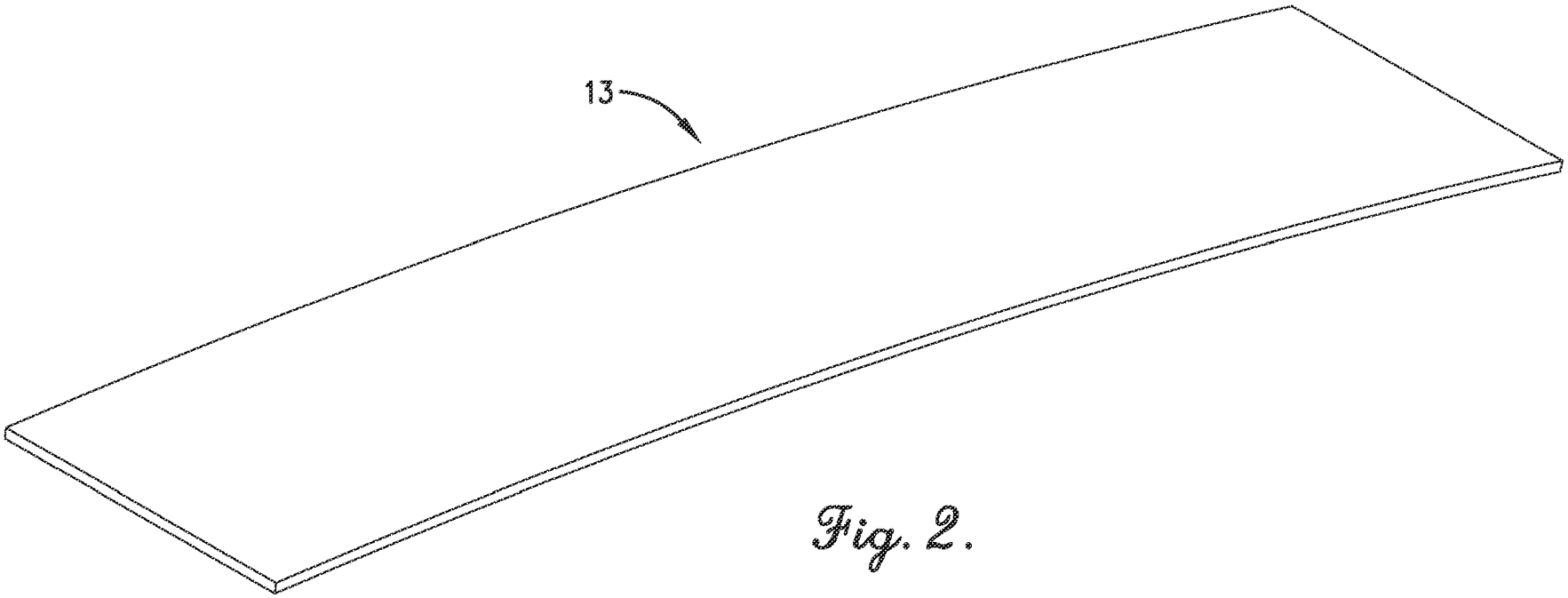
FIG. 2 is a perspective view of the formed composite component.

FIG. 1 depicts a system 10 constructed according to an embodiment of the present invention for performing methods described herein. The system 10 is a shaping tool operable to compress a preform 12 and wet it with a zinc-based molten metal 14 (as discussed above) to form a metal matrix composite component 13 (also depicted in FIG. 2). The preform 12 comprises fibrous material (as discussed above) coated with nickel and includes one or more wires 16 secured thereto. The wires 16 are commingled with the fibrous material. The system 10 comprises a rigid mold tool 18, an impermeable membrane 20, an inlet 22, a vacuum outlet 24, a vacuum pump 25, and a seal 26.

The rigid mold tool 18 and the membrane 20 cooperatively define a cavity 28 in which the preform 12 is positioned. The preform 12 is positioned on the rigid mold tool 18 and sealed within the impermeable membrane 20 via the seal 26. Distribution media 31 is positioned around the preform 12 to ensure the flow of the molten metal 14 into the preform 12. The distribution media 31 can include ceramic filter material, metal mesh filter material, metal or ceramic sponge material, or the like. The rigid mold tool 18 comprises any solid material with a melting point higher than the temperature of the molten metal. In embodiments, the rigid mold tool 18 comprises metal or ceramic. The impermeable membrane 20 comprises any flexible impermeable sheet or vacuum bagging material known in the art of composite manufacturing.

The molten metal 14 is introduced into the cavity 28 through the inlet 22, which is in fluid communication with the cavity 28, and the molten metal 14 fills the interstices of the preform 12 and flows onto the rigid mold tool 18. The molten metal 14 is introduced via a differential pressure that the vacuum pump 25 induces at the vacuum outlet 24, which is in fluid communication with the cavity 28, and through which air within the cavity 28 is evacuated.

By vacuuming out the air within the cavity 28, the molten metal 14 is drawn into the cavity 28 through the inlet 22, and the membrane 20 compresses the molten metal 14 and preform 12 to conform the molten metal 14 to the shape of the mold tool 18. The rigid mold tool 18 includes a top surface 30 for imparting a shape on the metal matrix composite component 13. The molten metal 14 and preform 12 are compressed until the fibers are fully wetted and the molten metal 14 is solidified to form the metal matrix composite component 13. The component 13 is cooled, removed from the system 10, heat treated, and finished.

The bag 20 and mold tool 18 enable making extremely large metal matrix composite parts, such as aircraft components, automobile chasses, and the like.

Figure 3:
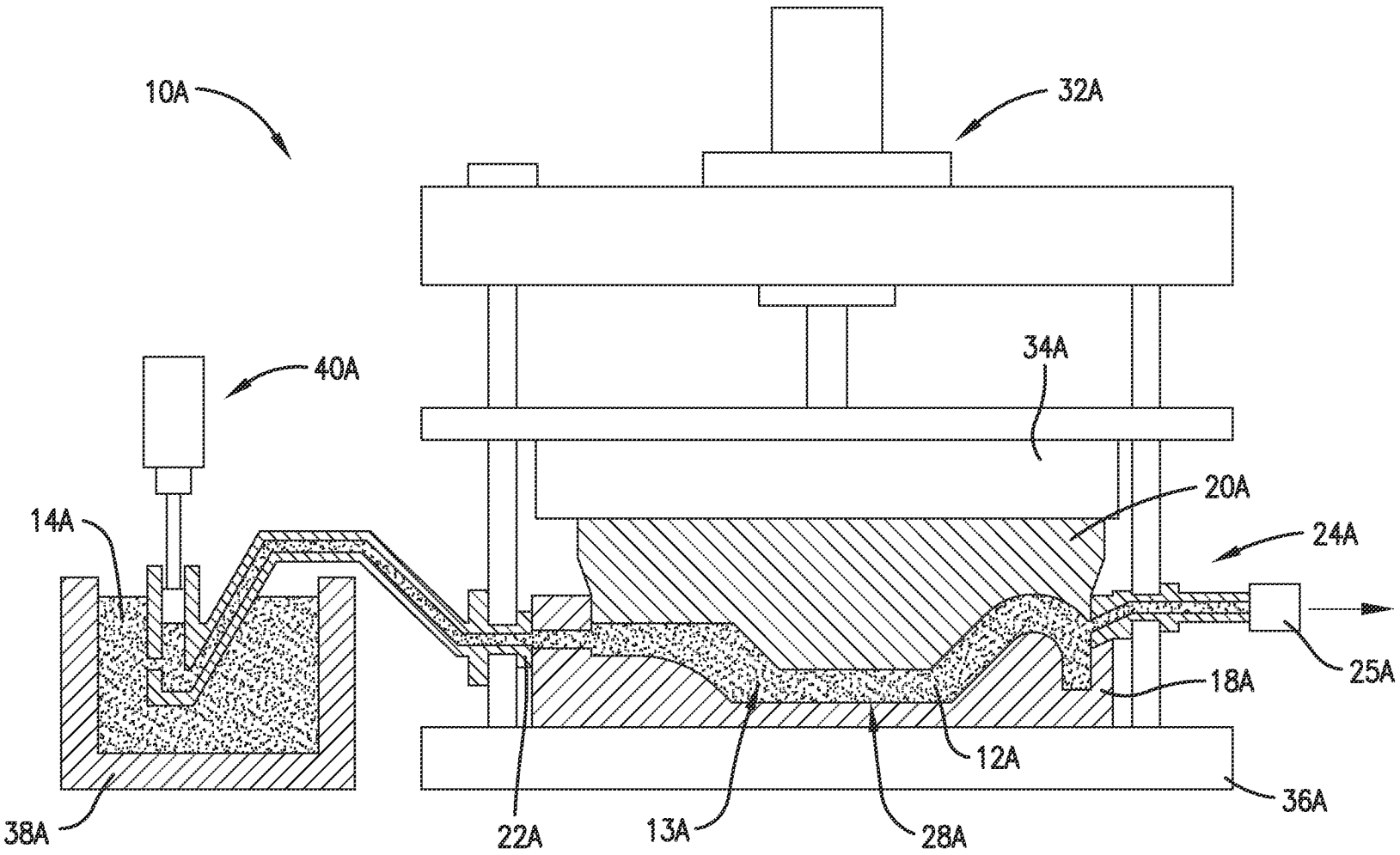
FIG. 3 is a schematic cross-sectional side view of a vacuum-assisted die casting system for forming a metal matrix composite component according to an embodiment of the present invention.

A system 10A constructed in accordance with another embodiment of the invention is shown in FIG. 3. The system 10A comprises some similar components as system 10; thus, the components of system 10A that correspond to similar components in system 10 have the same reference numerals with an 'A' appended thereto.

The system 10A is a vacuum assisted die casting system for forming a metal matrix composite component 13A out of a preform 12A and molten metal 14A. The preform 12A comprises nickel-coated fibrous material and/or one or more reinforcement wires (as discussed above) and the molten metal 14A is a zinc-based alloy (as discussed above). The system 10A comprises a shaping tool including a rigid bottom die 18A and a rigid top die 20A, an inlet 22A for receiving the molten metal 14A, a vacuum outlet 24A, a vacuum pump 25A, a press 32A comprising a heated press platen 34A and a heated press brake 36A, a crucible 38A that contains the molten metal 14A, and a plunger 40A for injecting the molten metal 14A into the dies 18A, 20A.

The bottom die 18A and the top die 20A cooperatively define a cavity 28A in which the preform 12A is positioned. The preform 12A is positioned between the bottom and top dies 18A, 20A and sealed within the cavity 28A. The dies 18A, 20A comprise any solid material with a melting point higher than the temperature of the molten metal, such as metal or ceramic materials. The dies 18A, 20A ensure consistent spacing of the molten metal 14A within the cavity 28A.

The vacuum pump 25A applies a differential pressure (lower pressure) at the outlet 24A, which is in fluid communication with the cavity 28A, so that the vacuum pump 25A and the plunger 40A cooperatively direct the molten metal 14A from the crucible 38A into the cavity 28A through the inlet 22A. The plunger 40A forces or pumps the molten metal 14A from the crucible 38A through the inlet 22A and into the cavity 28A. The molten metal 14A flows into the bottom die 18A and fills the interstices of the preform 12A.

The heated press platen 34A and the heated press brake 36A heat their respective dies 18A, 20A, and the press 32A actuates the heated platen 34A and the top die 20A toward the bottom die 18A to compress the molten metal 14A and preform 12A within the cavity 28A and to conform the molten metal to the shape of the cavity 28A. The molten metal and preform are compressed until the fibers of the preform 12A are fully wetted and the molten metal is solidified to form the metal matrix composite component. The component is cooled, removed from the cavity 28A, heat treated, and finished.

The plunger 40A and the differential pressure applied at the outlet 24A ensure that the nickel-coated fibers of the preform 12A are fully wetted, and the top die 20A ensures that the molten metal 14A takes the proper shape. This application of differential pressure enables manufacturing extremely large parts out of the metal matrix composite, such as components for aircrafts or vehicles.

Figure 4:
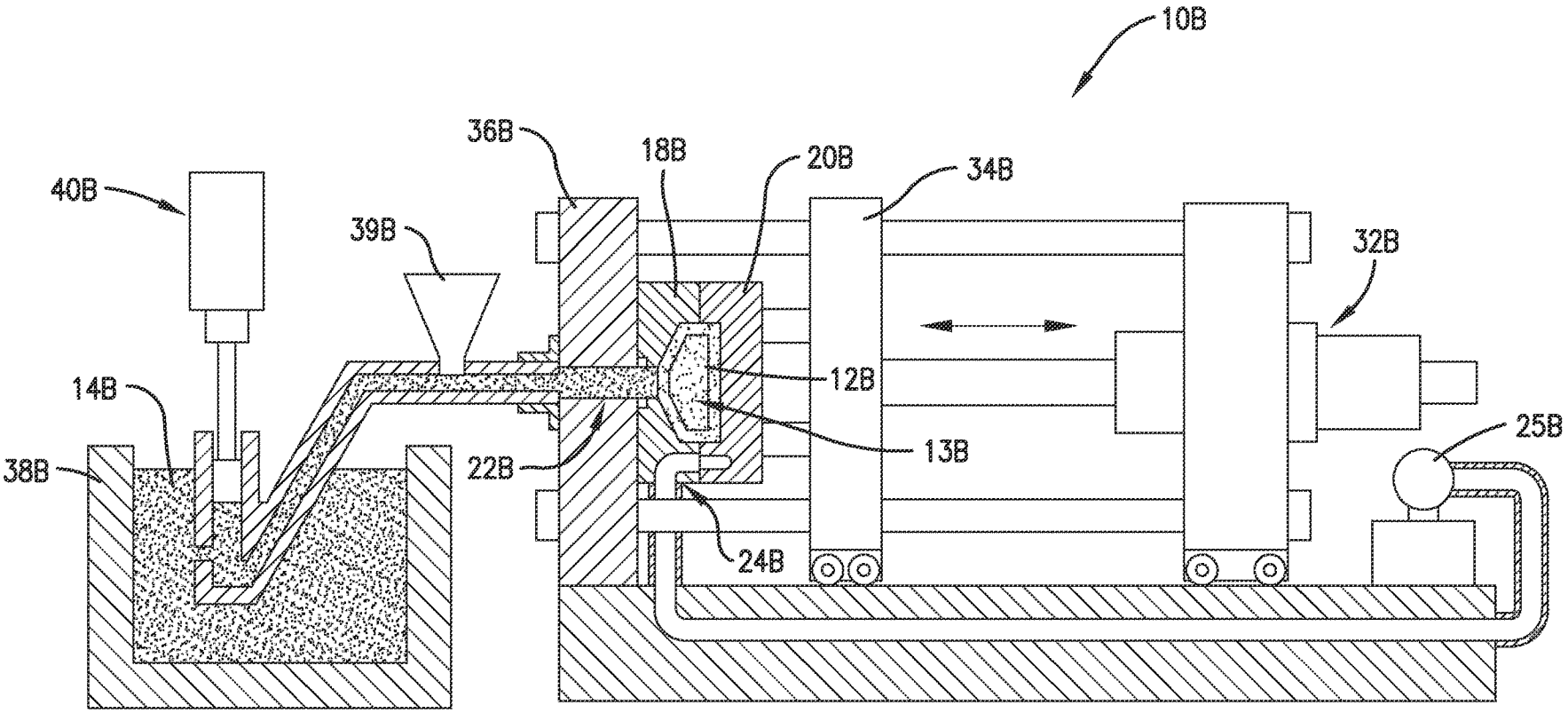
FIG. 4 is a schematic cross-sectional side view of a system for metal injection composite casting according to an embodiment of the present invention.
Figure 5:
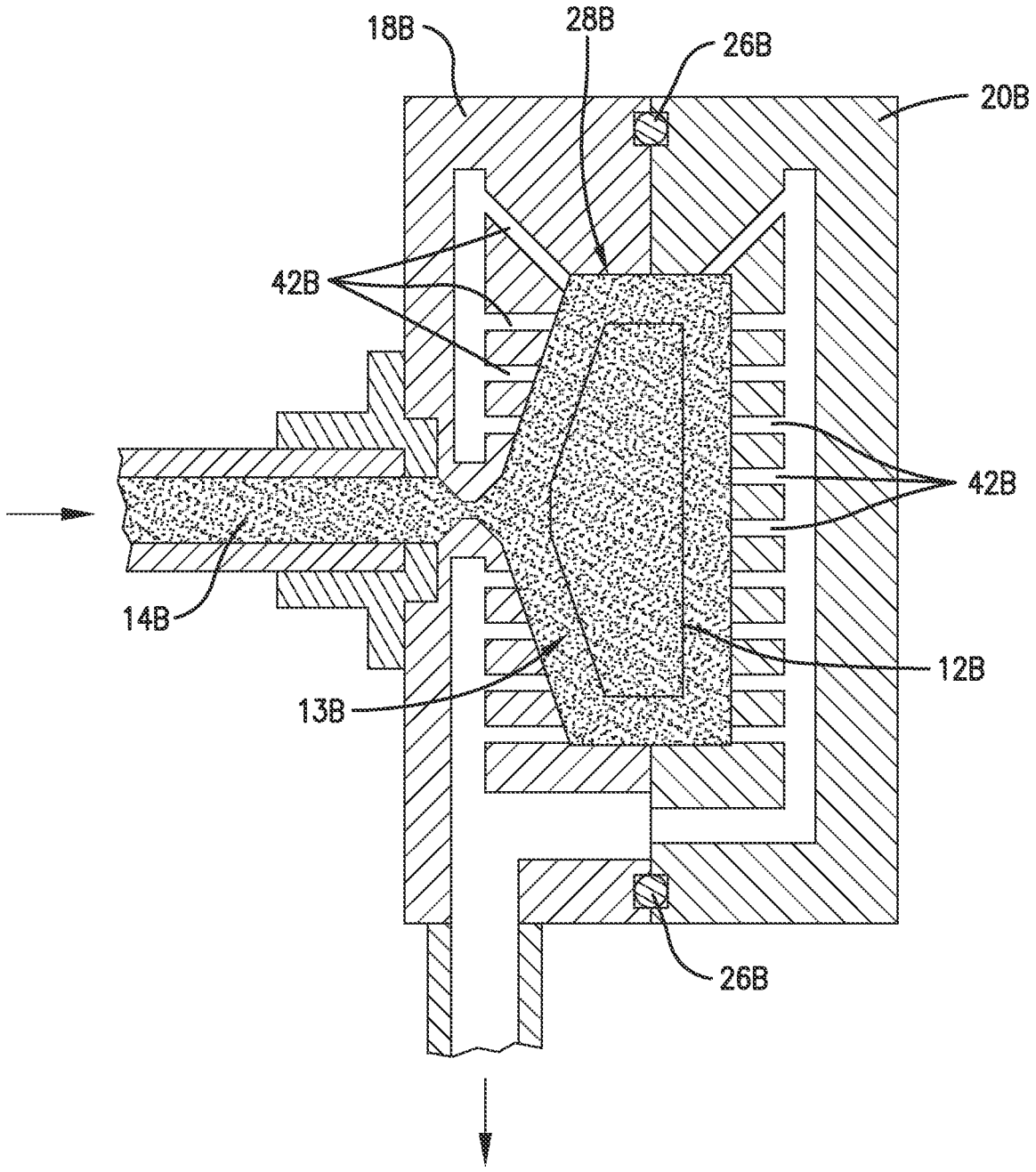
FIG. 5 is a schematic cross-sectional side view of dies of the system of FIG. 4.

A system 10B constructed in accordance with another embodiment of the invention is shown in FIGS. 4 and 5. The system 10B comprises some similar components as system 10A; thus, the components of system 10B that correspond to similar components in system 10A have the same reference numerals with a 'B' appended thereto instead of an 'A'.

Turning to FIG. 4, the system 10B is a vacuum assisted die casting system for forming a metal matrix composite component 13B. In some embodiments, an insert 12B comprising nickel-coated fibrous material (discussed above) is used; however, in some embodiments, the nickel-coated fibrous material is mixed with the zinc-based molten metal 14B, and an insert is not used. The system 10B comprises a shaping tool including a rigid first die 18B and a rigid second die 20B, an inlet 22B for receiving the molten metal 14B, a vacuum outlet 24B, a vacuum pump 25B, a seal 26B (depicted in FIG. 5), a press 32B comprising a shiftable platen 34B and a stationary platen 36B, a crucible 38B that contains the molten metal 14B, a plunger 40B for injecting the molten metal 14B into the dies 18B, 20B, and a hopper 39B that stores nickel-coated fibers and mixes them into the molten metal 14B.

Turning to FIG. 5, the first and second dies 18B, 20B cooperatively define a cavity 28B in which the insert 12B is optionally positioned. The dies 18B, 20B include a plurality of channels 42B formed therein that are in fluid communication with the cavity 28B and the outlet 24B. The inlet 22B directs molten metal 14B into the cavity 28B, and the vacuum pump 25B applies a differential lower pressure at the channels 42B, which are interconnected with the cavity 28B and therefore apply the differential pressure to the cavity 28B to ensure the molten metal 14B fills the cavity 28B and the interstices of the insert 12B. The cavity 28B is sealed by the seal 26B, which extends around the cavity 28B and the channels 42B at the interface between the dies 18B, 20B. The dies 18B, 20B comprise any solid material with a melting point higher than the temperature of the molten metal, such as metal or ceramic materials.

Turning back to FIG. 4, the vacuum pump 25B applies a differential pressure (lower pressure) at the outlet 24B, so that the vacuum pump 25B and the plunger 40B cooperatively direct the molten metal 14B from the crucible 38B into the cavity 28B. The plunger 40B forces or pumps the molten metal 14B from the crucible 38B through the inlet 22B and into the cavity 28B. The hopper 39B supplies nickel-coated fibers to the molten metal 14B flowing into the cavity 28B.

The press 32B actuates the platen 34B and the second die 20B toward the first die 18B to compress the molten metal 14B and insert 12B within the cavity 28B to conform the molten metal to the shape of the cavity 28B. The molten metal and insert are compressed until the nickel-coated fibers of the insert 12B and/or the fibers supplied via the hopper 39B are fully wetted and the molten metal is solidified to form the metal matrix composite component. The component is cooled, removed from the cavity 28B, heat treated, and finished.

The plunger 40B and the vacuum pump 25B enable rapid manufacturing of high-strength, fiber-reinforced, zinc-based components. Mixing nickel-coated fibers from the hopper 39B enables the use of chopped, recycled fibers, which reduces waste and costs for producing such components.

Figure 6:
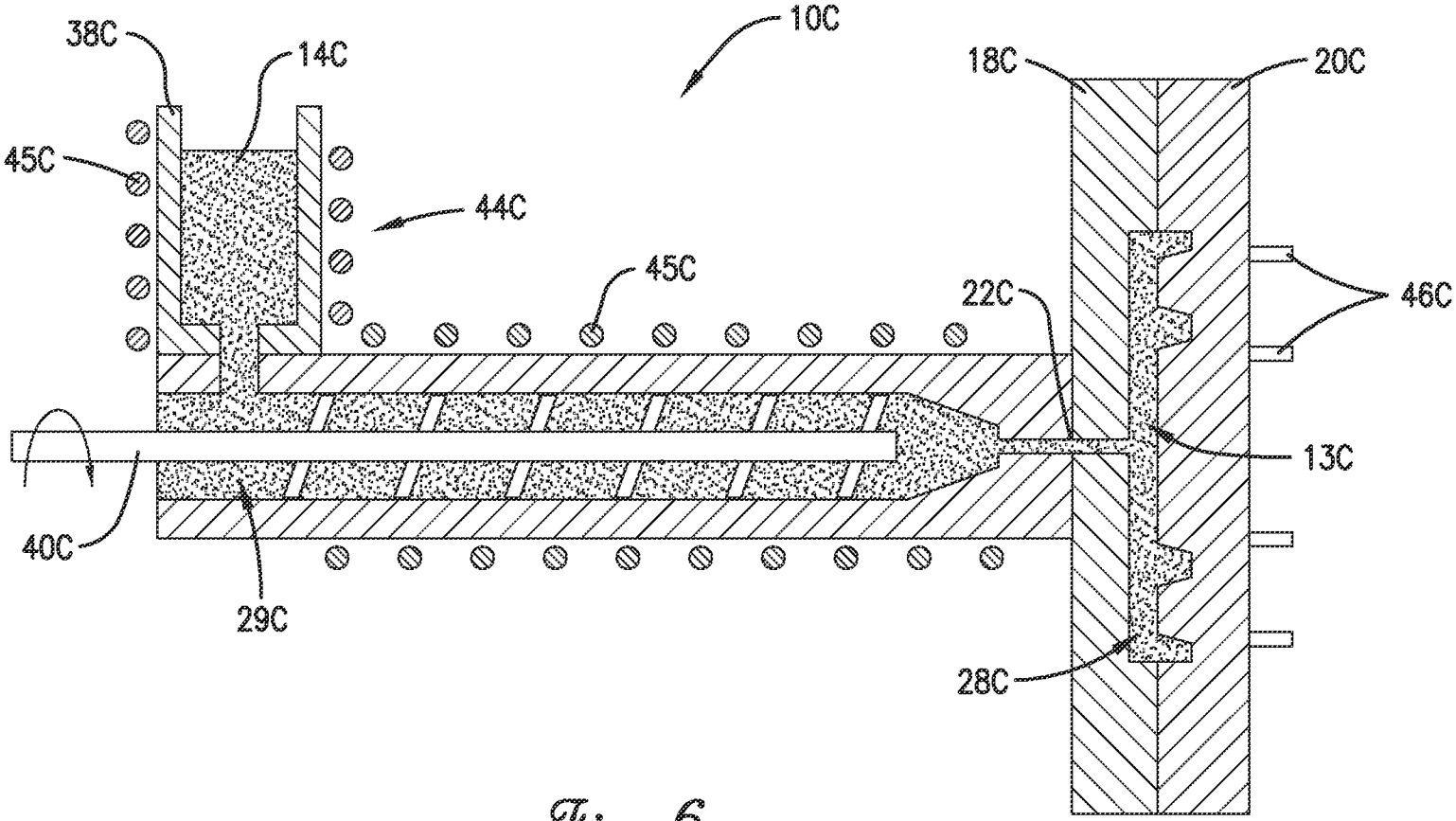
FIG. 6 is a schematic cross-sectional side view of a system for metal injection composite casting according to another embodiment of the present invention.

A system 10C constructed in accordance with another embodiment of the invention is shown in FIG. 6. The system 10C comprises some similar components as system 10B; thus, the components of system 10C that correspond to similar components in system 10B have the same reference numerals with a 'C' appended thereto instead of a 'B'.

The system 10C is an injection casting system for forming a metal matrix composite component. The nickel-coated fibrous material is mixed with the zinc-based molten metal 14C in a heated crucible 38C (discussed in more detail below). The fibrous material comprises chopped, nickel-coated fibers and is pre-mixed with pellets of the metal 14C comprising the zinc-based metals (discussed above). The system 10C comprises a shaping tool with a rigid first die 18C and a rigid second die 20C, an inlet 22C for receiving the molten metal 14C, a heated crucible 38C, an injection screw 40C for injecting the molten metal 14C and nickel-coated fibers into the dies 18C, 20C, heating elements 44C for heating the molten metal, and ejector pins 46C for removing the metal matrix composite component.

The zinc-based molten metal and nickel-coated chopped fibers flow from the heated crucible 38C into a chamber 29C in fluid communication with the inlet 22C. The heating elements 44C comprise heater coils 45C that heat the crucible 38C and the walls of the chamber 29C. The injection screw 40C pumps or drives the molten metal and fibers in the chamber 29C through the inlet 22C, thereby injecting them into a cavity 28C defined by the first and second dies 18C, 20C. The injection screw 40C is operable to move in and out of the chamber 29C as well as rotating in order to effectively mix and inject the molten metal and nickel-coated fiber into the mold cavity 28C. The dies 18C, 20C are operable to be separated, and the ejector pins 46C extend into the second die 20C and are operable to be actuated to push the solidified metal matrix composite component out of the second die 20C. The dies 18C, 20C comprise any solid material with a melting point higher than the temperature of the molten metal, such as metal or ceramic materials. In some embodiments, the dies 18C, 20C comprise steel.

The injection screw 40C, heating elements 44C, and low melting temperature of zinc enable rapid manufacturing of high-strength, fiber-reinforced, zinc-based parts. Mixing nickel-coated fibers in the crucible 38C enables the use of chopped, recycled fibers, which reduces waste and costs for producing such components.

Figure 7:
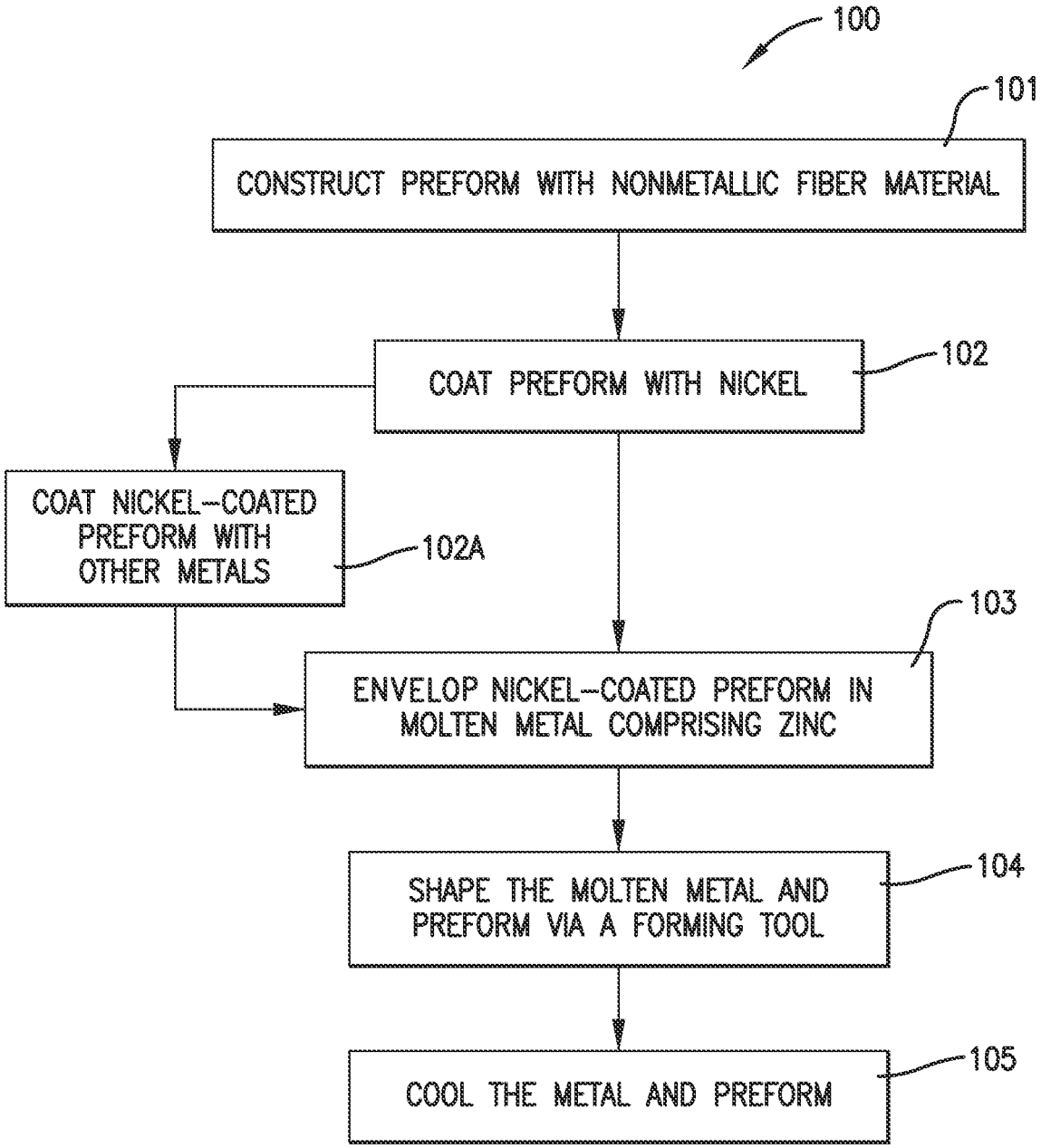
FIG. 7 is a flow chart of a method for forming a metal matrix composite component in accordance with an embodiment of the present invention.

The flow chart of FIG. 7 depicts the steps of an exemplary method 100 of forming a metal matrix composite component (such as the metal matrix composite components 13, 13A, 13B, 13C depicted in FIGS. 1-6). The method 100 is described below, for ease of reference, as being executed by exemplary devices and components introduced with the embodiments illustrated in FIGS. 1-6.

Referring to step 101, a preform comprising fibrous material is formed to a desired shape. The fibrous material comprises any of the fibrous material as discussed above. In some embodiments, the fibrous material includes multiple types of fibrous material, and the preform includes reinforcement wires (as discussed above) secured to and/or commingled with the fibrous material.

Referring to step 102, the preform is coated with a first metal. In embodiments, the fibrous material is coated with nickel, which allows encapsulation of the fibrous material into the zinc-based molten metal discussed below. In embodiments, the nonconductive fibrous material is coated via electroless nickel plating.

Referring to step 102A, in some embodiments, additional metal coatings are optionally applied to the nickel-coated preform to achieve desired properties in the metal matrix component. In some embodiments, this step further includes coating the reinforcement wires with nickel for particular zinc alloy formulations. Additionally, the nickel-coating is performed via electrodeposited nickel-plating processes to coat conductive portions of the preform and/or reinforcement wires. In some embodiments, one or more coatings of the preform are applied via chemical vapor deposition.

Referring to step 103, the nickel-coated preform is enveloped by zinc-based molten metal. The nickel-coated preform is positioned in a shaping tool, such as on a mold tool within a vacuum bag or between two or more dies. The molten metal is directed into the shaping tool via differential pressure and/or via a pump, such as a casting plunger, injection screw; or the like. In some embodiments, the molten metal is directed into a gravity cast shaping tool.

Referring to step 104, the molten metal and preform are shaped via the shaping tool. The shaping tool compresses the molten metal and preform so that the molten metal wets the preform and solidifies in the shape of the shaping tool. This step includes compressing the molten metal via a vacuum bag or between two or more dies.

Referring to step 105, the molten metal is cooled. The molten metal is held in the shaping tool at least until it is no longer a liquid. The cooled molten metal and preform form the metal matrix composite component, which is removed, heat treated, and finished.

The method 100 may include additional, less, or alternate steps and/or device(s), including those discussed elsewhere herein.

Figure 8:
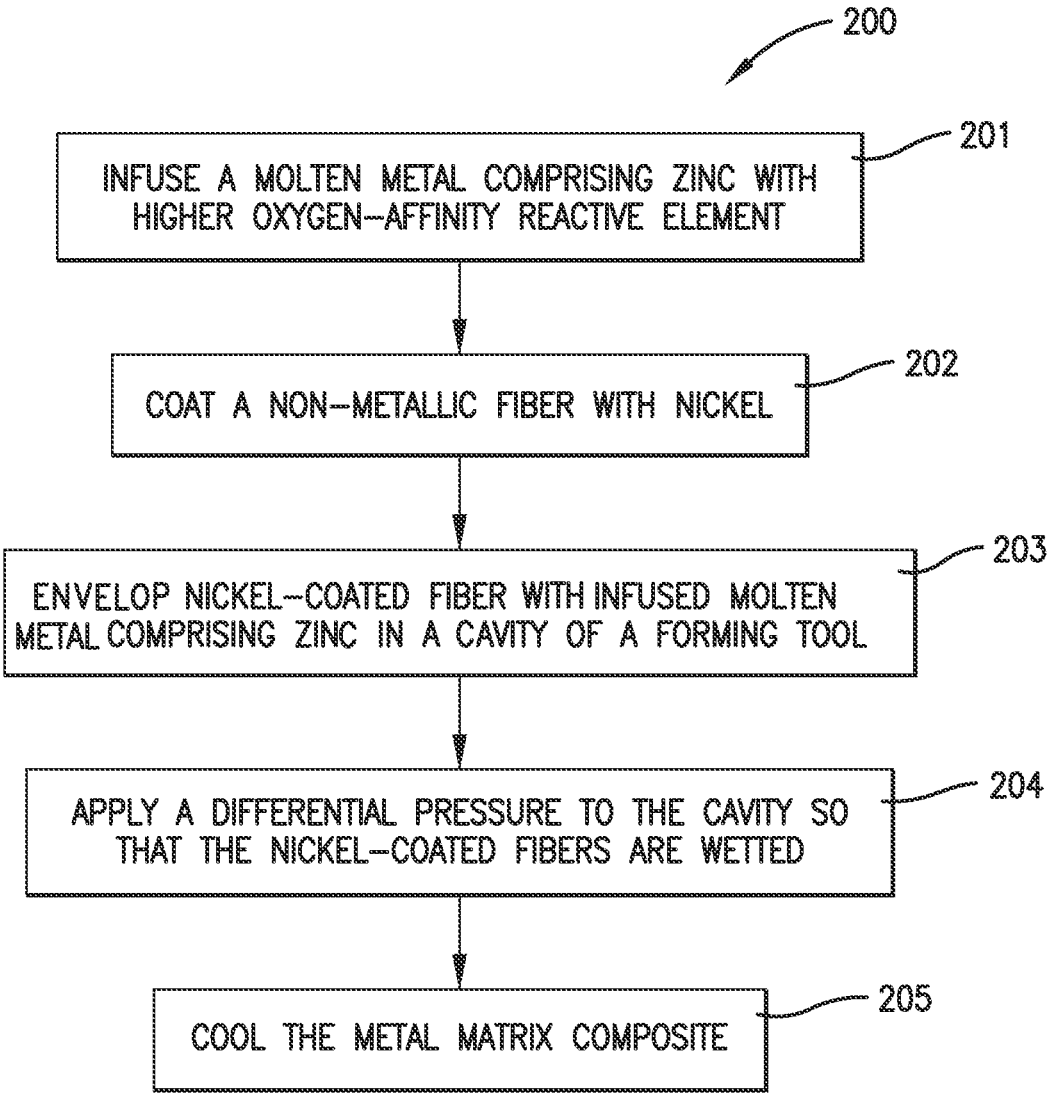
FIG. 8 is a flow chart of a method for forming a metal matrix composite in accordance with an embodiment of the present invention.

The flow chart of FIG. 8 depicts the steps of an exemplary method 200 of forming a metal matrix composite. In some alternative implementations, the functions noted in the various blocks may occur out of the order depicted in FIG. 8. For example, two blocks shown in succession in FIG. 8 may in fact be executed substantially concurrently, or the blocks may sometimes be executed in the reverse order depending upon the functionality involved. In addition, some steps may be optional. The method 200 is described below, for ease of reference, as being executed by exemplary devices and components introduced with the embodiments illustrated in FIGS. 1-6.

Referring to step 201, zinc-based molten metal (as discussed above) is infused with an element with a capacity to deoxidize molten metal. This encourages removal of oxide films and complete wetting/mixing of coated fibers into the metal matrix. The added element has a higher affinity for oxygen (lower free energy) than nickel and is added in the range of 0.05% to 1.5% by weight to the zinc-based molten metal. In embodiments, the added element includes at least one of boron, titanium, silicon, zirconium, hafnium, manganese, phosphorous, a rare earth element, or the like.

Referring to step 202, electrically nonconductive fiber (as discussed above) is coated with nickel. The nonconductive fibrous material is coated via electroless nickel plating. In some embodiments, the electrically nonconductive fiber comprises two or more types of fiber material. In some embodiments, additional metal coatings are applied to the nickel-coated fiber, reinforcement wires are secured to or commingled with the fiber. In such embodiments, the reinforcement wires are coated with nickel via electrodeposited nickel-plating processes. In some embodiments, one or more of the coatings are performed via chemical vapor deposition.

Referring to step 203, the nickel-coated fiber is enveloped by the infused zinc-based molten metal. In some embodiments, the nickel-coated fiber is positioned in a cavity of a shaping tool, such as on a mold tool within a vacuum bag or between two or more dies.

Referring to step 204, a differential pressure is applied to the cavity so that the nickel-coated fibers are fully wetted by the molten metal. The molten metal is directed into the shaping tool via differential pressure and via a pump, such as a casting plunger, injection screw, or the like. The differential pressure is applied via a vacuum pump in fluid communication with the cavity. The shaping tool compresses the molten metal and the fiber so that the molten metal wets the fiber, thereby filling the interstices of the fiber. This step includes compressing the molten metal via a vacuum bag or between two or more dies.

Referring to step 205, the molten metal is cooled. The molten metal is held in the shaping tool at least until it is no longer a liquid. The cooled molten metal and fiber form the metal matrix composite, which is removed from the shaping tool, heat treated, and finished.

The method 200 may include additional, less, or alternate steps and/or device(s), including those discussed elsewhere herein.

Although the invention has been described with reference to example embodiments illustrated in the attached drawing figures, it is noted that equivalents may be employed and substitutions made herein without departing from the scope of the invention as described and claimed herein.

What is claimed is:

1. A method of forming a metal matrix composite component, the method comprising:

positioning a preform comprising an electrically nonconductive fibrous material in a shaping tool, wherein the fibrous material is pre-coated, wherein the preform comprises a metallic wire;

flowing a molten metal comprising zinc into the shaping tool so that at least a portion of the preform is enveloped by the molten metal to form the metal matrix composite component;

cooling the metal matrix composite component; and compressing the molten metal and the portion of the preform;

wherein the shaping tool comprises a mold tool and a bag that at least partially encloses the mold tool, and compressing the molten metal and the portion of the preform includes: reducing a pressure within the bag with the molten metal and the portion of the preform on the mold tool.

2. The method of claim 1, further comprising coating a fibrous material with nickel via electroless nickel plating to form the fibrous material that is pre-coated.

3. The method of claim 1, wherein the wire comprises at least one of zinc, titanium, aluminum, steel, or copper.

4. The method of claim 1, wherein the wire has a coating comprising nickel.

5. The method of claim 1, further comprising infusing the molten metal with at least one of boron, titanium, zirconium, hafnium, silicon, manganese, phosphorous, or a rare earth element.

6. The method of claim 1, wherein the fibrous material is at least one of polyamide fiber, carbon fiber, silica fiber, silicon carbide fiber, aluminum oxide fiber, magnesium oxide fiber, or basalt fiber.

7. The method of claim 1, wherein the shaping tool defines a cavity in which the preform is positioned and includes an inlet and an outlet in fluid communication with the cavity, and introducing the molten metal into the shaping tool includes: lowering a pressure at the outlet.

8. The method of claim 7, wherein introducing the molten metal into the shaping tool includes: pumping the molten metal into the inlet.

9. The method of claim 1, wherein the molten metal does not include magnesium.

10. The method of claim 1, wherein the preform comprises at least two different types of fibrous material.

* * * * *